United States Patent [19]

Kim

[11] Patent Number: 4,915,755

[45] Date of Patent: Apr. 10, 1990

[54] FILLER REINFORCEMENT OF POLYURETHANE BINDER USING A NEUTRAL POLYMERIC BONDING AGENT

[76] Inventor: Chung S. Kim, 1955 Santa Maria Way, Sacramento, Calif. 95825

[21] Appl. No.: 104,789

[22] Filed: Oct. 2, 1987

[51] Int. Cl.[4] ..... C06B 45/10

[52] U.S. Cl. ..... 149/19.4; 149/19.92

[58] Field of Search ..... 149/19.2, 19.4, 19.92, 149/19.93

[56] References Cited

U.S. PATENT DOCUMENTS

| | | | |
|---|---|---|---|
| 4,038,115 | 7/1977 | Dehm | 149/19.8 |
| 4,050,968 | 9/1977 | Goldhagen et al. | 149/19.4 |
| 4,221,617 | 9/1980 | Rudy et al. | 149/19.92 |
| 4,343,664 | 8/1982 | Iyer | 149/19.92 |
| 4,350,542 | 9/1982 | Kincaid et al. | 149/11 |
| 4,376,083 | 3/1983 | Ulsteen | 149/19.92 |
| 4,389,263 | 6/1983 | Allen | 149/19.4 |
| 4,445,948 | 5/1984 | Stanton et al. | 149/19.92 |
| 4,517,035 | 5/1985 | Duchesne et al. | 149/19.92 |
| 4,658,578 | 4/1987 | Shaw | 149/19.4 |

*Primary Examiner*—Edward A. Miller

*Attorney, Agent, or Firm*—Alfred D. Lobo

[57] ABSTRACT

An effective neutral polymeric bonding agent (NPBA) is disclosed for a polar filler such as crystals of a nitramine (HMX or RDX, for example) dispersed in a polar binder, such as energetic binders containing nitro- and nitrato-plasticizers. The exceptional strength of the propellant composite of this invention is derived from a NPBA tailored to conform to criteria found to take advantage of the surface and absorption properties of the system so as to inculcate such strength. In particular, an interpolymer of acrylonitrile, methylacrylate and hydroxyethylacrylate can be tailored to provide a NPBA for a submix of a OH-terminated prepolymer and polar nitro- or nitratoplasticizers, such as nitroglycerine, which have solubility parameters in about the same range. Typically the submix includes HMX, RDX, ammonium perchlorate and the like along with fuel particles such as aluminum, boron, and the like.

14-Claims, 3 Drawing Sheets

FILLER REINFORCEMENT OF POLYURETHANE BINDER USING A NEUTRAL POLYMERIC BONDING AGENT

This invention was made with Government support under Contract N00014-85-K-0777 awarded by the Department of the Navy. The Government has certain rights in the invention.

BACKGROUND OF THE INVENTION

This invention relates, in general, to composites of polymers reinforced with finely divided solid particles (filler). The polymer component is derived from a prepolymer, for example a hydroxy-terminated (OH-terminated) prepolymer, cured with a curing agent, in this case, a polyfunctional isocyanate. The prepolymer may be combined with a plasticizing agent (plasticizer). In one embodiment, the filler may be inert particles such as clay, calcium carbonate or glass beads, as for example in synthetic concrete, or an abrasive particle such as silicon carbide in a grinding wheel. In another embodiment, the filler may be oxidizer and/or fuel for a solid propellant, in particular, a composite such as is formed within a confined space, for example the casing of a rocket, upon curing of a binder matrix or binder system. Such composites are referred to as propellant composites in which particles of a solid propellant are held together by a cured submix, the submix comprising a plasticizer, the prepolymer and modifiers such as burning rate additives, wetting agents, and the like. The binder matrix is formed by curing the submix, after the filler is added, with the curing agent, optionally with the addition of a curative catalyst.

The solid particles in the propellant typically include an oxidizing agent (oxidizer) such as cyclotetramethylenetetranitramine (HMX) and/or cyclotrimethylenetrinitramine (RDX), or other nitramine ($N—NO_2$) group containing crystals, together referred to herein as 'nitramines', other oxidizers such as ammonium perchlorate, ammonium nitrate and the like, as well as fuel particles of boron, aluminum, metal and organic hydrides, and the like.

Composites of this invention are said to be filler-reinforced because of the strength they derive from the use of a neutral polymeric bonding agent which is thought to form hard and tough shells around the filler particles. With sufficiently good bonding, extensive dilatation upon extension of the propellant is prevented.

In the prior art, a strong interfacial bonding in the composite is obtained by mixing a bonding agent into a premix slurry during processing in a non-polar polybutadiene-based and polypropylene glycol based propellants. Examples of typical bonding agents for hydroxy-terminated polybutadiene (HTPB) and polypropylene glycol (PPG) are basic amine oligomers, small molecules such as alkanolamines, alkanol amides, Dantocol and amine salts. They readily undergo chemisorption or adsorption on polar solid particles since the binder matrix is non-polar, but in a polar binding system where a nitro- or nitration group containing plasticizer is used, the prior bonding agents are ineffective since they are too soluble in the polar submix.

In U.S. Pat. No. 4,410,376, for example, Bruenner et al note that 2,3-dihydroxypropyl-bis(2-cyanoethyl)amine is soluble in the binder phase only to the extent that it can be adsorbed on the filler particles. If too soluble, as it is in a nitroplasticized energetic system, it becomes inefficient. But, other than by trial and error, there has been no suggestion as to how to choose a bonding agent with a high degree of probability that it might be an effective bonding agent.

Given the desirability of depositing the bonding agent from the submix, Bruenner et al disclose the problems of doing so, using a polar binder. They recognized that 2,3-dihydroxypropyl-bis(2-cyanoethyl)amine was not only too soluble, but also that its high basicity degraded the composite. Therefore they partially neutralized the molecule and tried hard to maintain some of the free amino groups to get the chemisorption on the surface of the nitramine particles. It remained a small molecule with a molecular weight (mol wt) no greater than about 1000, having few contact points (or anchoring sites) per molecule, to the surface of a filler particle, and they had no suggestion as to what changes might be made to improve the bonding in a polar system. By "anchoring sites" I refer to the multiplicity of sites on a large flexible molecule, such as a polymer, which are available for adsorption on the surface of a filler particle. A relatively small molecule has few such sites.

It is evident that if Bruenner et al completely neutralized the TEPAN there would be no basic amino groups for the chemisorption which is instrumental in their obtaining effective interfacial bonding.

In a composite in which plasticized urethane rubber serves as the polar binder matrix, the binder matrix is formed by end-linking hydroxy-terminated prepolymers with polyfunctional (di-, tri-, or higher) isocyantes. Curing takes place after the slurry has been cast, usually into a chamber of a rocket motor.

A good bonding agent should (i) be accumulated on the surface of the solid particles of filler, (ii) undergo a crosslinking reaction with a curing agent to form the hard and tough shell around the solid particles, and (iii) have enough functional groups left over to form primary bonds between the shells and the binder matrix.

When successfully executed, the "bonding agent method" of this invention is effective without pre-coating the filler, and is economically advantageous over any method comprising pretreating or precoating the solids.

In the prior art, in a polar binder matrix, bonding agents provide interfacial bonding only when they are used to precoat the filler so as to form hard and tough shells enveloping the filler particles. The result is "filler reinforcement" which increases strength and stiffness of a composite by interfacial bonding between the filler particles and the generally elastomeric matrix. Nonreinforcing fillers do not substantially increase the tensile strength because there is little interfacial bonding, thus suffer dewetting upon deformation.

The choice of plasticizer is not narrowly critical provided that it is polar, and it may be a 1/1 mixture of bis(dinitropropyl)formal and bis(dinitropropyl)acetal (BDNPF/A), bis(fluorodinitroethyl)formal (FEFO), nitratoesters including but not limited to nitroglycerin (NG), metrioltrinitrate (METN), trimethyloltrinitrate (TMETN), butanetrioltrinitrate (BTTN), diethyleneglycoldinitrate (DEGDN), and triethyleneglycoldinitrate (TEGDN), or any combination of the foregoing, inter alia.

This invention specifically relates to polyurethane composites in which the solid particles are not precoated prior to mixing the components of the composite. Instead, the bonding agent is added during processing to yield interfacial bonding.

More specifically, this invention relates to a neutral polymeric bonding agent (NPBA) which nevertheless is adsorbed on the surface of polar filler particles from a polar submix. In general, a prior art bonding agent for a non-polar binder such as OH-terminated polybutadiene, is ineffective in my system. For example, a polar small molecule (less than about 1000 mol wt) bonding agent is ineffective because my binder is polar and these small molecules remain in the submix; small molecules do not have a sufficiently large number of anchoring sites per molecule to be effectively adsorbed. Also, prior art basic oligomer bonding agents such as TEPAN and partially neutralized TEPAN, are likely to cause poor cure and/or degradation of energetic polymers and plasticizers. By "energetic" I refer to materials containing nitro-, nitrato- and/or azido polar groups.

This invention is specifically concerned with nitramine crystal/polar binder systems for which my NPBA is found to be most effective. By "neutral" I refer to a binder free of amine and acid groups (but not a salt), having a pH in the range from pH 5.5 to about pH 8.5, and more preferably from pH 6 to pH 8. In the past, the search for the most effective bonding agent was heretofore carried out by trial and error, by making and testing batch after batch of propellant with a wide variety of potential bonding agents including nitrocellulose (NC). Though neutral and polymeric, NC is either too soluble and does not undergo phase separation at the slurry processing temperature, or is insoluble in the submix, and therefore, in either case, is ineffective. The slurry processing (or 'slurry mix') temperature is a predetermined temperature in a narrowly defined range, typically a range less than 5° C. (9° F.), for a selected submix. The criteria for solubility of the NPBA in the submix are described hereinbelow.

SUMMARY OF THE INVENTION

It has been discovered that certain criteria allow a neutral polymeric bonding agent (NPBA) to be designed for a preselected propellant composite, with much less trial and error than in the past, and these criteria have been identified. Further, a simple method has been found to screen potential NPBAs which method minimizes the trial and error required, so that mixing and testing batches of propellants is much less laborious. By "non-nitrocellulosic" ("non-NC") I refer to a bonding agent free from NC, or a residue thereof.

Specifically, it has been discovered that a bonding agent will be an effective bonding agent for an energetic solid propellant in which a polar submix comprises a OH-terminated prepolymer and a polar plasticizer, optionally with other desirable additives, if it fulfills the following requirements:

(i) the bonding agent is neutral and polymeric, that is, a neutral polymeric bonding agent (NPBA) free of amine and acid groups, and has a number average molecular weight (Mn) in the range from about 3000 to about 500,000, preferably from 5000 to 100,000;

(ii) the NPBA contains multiple hydroxyl groups per molecule so that enough are available to crosslink with isocyanate to give hard and tough shells around the solid filler particles, and still have sufficient OH groups left to undergo primary bonding with the binder matrix;

(iii) the NPBA is uniformly distributed in the submix at a temperature above the slurry processing temperature which is in the range from about 27° C. to 71° C. (80° F. to 160° F.), preferably in the range from 32° C. to 60° C. (90° F. to 140° F.), so as to form a single phase;

(iv) the NPBA undergoes phase separation at the slurry processing temperature; and, (v) the NPBA has a high affinity for the solid particles.

It is therefore a general object of this invention to provide a basis for tailoring an effective bonding agent for any composite, and more specifically, to provide a basis for the synthesis of a NPBA having designed mol wt, and repeating units which include preselected pendant groups chosen to meet the foregoing conditions for an effective NPBA.

It is also a general object of this invention to provide a propellant composite of a synthetic resinous material and finely divided solid filler particles which remain essentially undissolved in a submix, and on which filler particles a NPBA is deposited from a single phase being adsorbed on said particles essentially free of any primary chemical bonds thereto, thereafter adding a curing agent to cure the polymer and form a filler reinforced composite in which the filler is essentially uniformly distributed.

It is another general object of this invention to provide a propellant composite of polar solid particles and a polar polyurethane binding system combined with a NPBA, said composite produced by a process comprising, (a) forming a submix of (i) a generally available polar OH-terminated prepolymer having a number average molecular weight (Mn) in the range from about 1000 to about 50,000, preferably in the range from 2000 to 15,000 so as to be pourable at casting temperature, and a solubility parameter (SP) in the range from about 9 $(cal/cm^3)^{\frac{1}{2}}$ *to about* 15 $(cal/cm^3)^{\frac{1}{2}}$, and, (ii) a polar plasticizer having a SP in about the same range as the prepolymer, (b) uniformly dispersing a NPBA in the submix to form a single phase, (c) adding polar solid filler particles having a SP greater than about 10 $(cal/cm^3)^{\frac{1}{2}}$, preferably above 14 $(cal/cm^3)^{\frac{1}{2}}$, including nitramines or ammonium perchlorate and ammonium nitrate particles free of a precoat, while maintaining the temperature above the slurry processing temperature to form a fluent mass, said particles being in an amount sufficient to provide a composite of preselected density, (d) cooling said fluent mass to the slurry processing temperature at which the NPBA undergoes phase separation from the submix so as to coat said filler particles, (e) adding a polyfunctional isocyanate curing agent, optionally with a catalyst curative, in an amount sufficient to react with essentially all the OH-groups, the point of addition of the curing agent being determined by the reactivity of the system, and, (e) casting the fluent mass to cure in a mold of arbitrary shape and size.

It is a specific object of this invention to provide an acrylonitrile or acrylamide interpolymer NPBA in which a comonomer contains at least 3 OH groups per molecule of NPBA when the prepolymer is to be cured with a polyfunctional isocyanate curing agent; and the relative molar amounts of the other monomers and the mol. wt of the interpolymer formed is chosen with relation to the polarity of the submix.

It is also a specific object of this invention to provide a novel propellant composite comprising a polar polyurethane binder, polar solid filler particles, and an effective amount of an interfacial bond-improving NPBA having, on average, from 3 to about 100 OH groups per molecule and a mol wt preferably in the range from 5000 to about 100,000, said NPBA being represented by the formula:

$$[(RP^1)_x-(RP^2)_y-(RP^3)_z]m$$

wherein $RP^1$ represents a repeating unit selected from the group consisting of

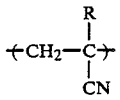
(i)

wherein R is H or methyl,

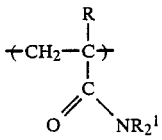
(ii)

wherein $R^1$ represents H or $CH_2CH_2CN$,

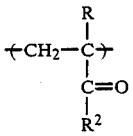
(iii)

wherein $R^2$ represents $C_1$-$C_4$ alkyl,

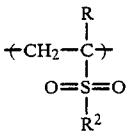
(iv)

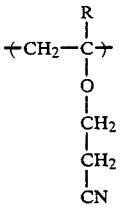
(v)

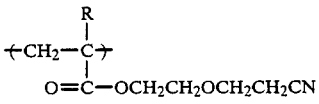
(vi)

and

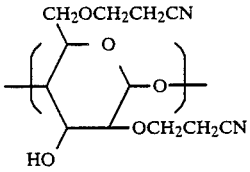
(vii)

$RP^2$ represents a repeating unit selected from the group consisting of

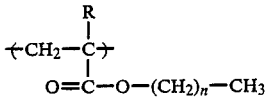
(i)

wherein n is an integer in the range from 1 to about 6

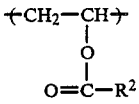
(ii)

and,

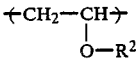
(iii)

$RP^3$ is any repeating unit containing an isocyanate-reactive OH group, preferably selected from the group consisting of

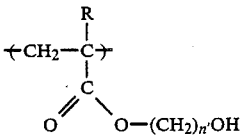
(i)

wherein n' is an integer from 2 to 6

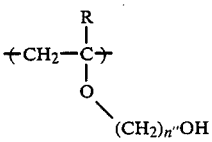
(ii)

wherein n'' is an integer from 0 to 6

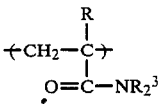
(iii)

wherein $R^3$ is H or $CH_2CH_2OH$, but only one may be H; x, y and z are numbers chosen so that the ratio $z/(x+y)$ is in the range from about 0.05 to 0.5, preferably from 0.05 to 0.3; the ratio y/x ranges from 0 to about 1.0; x, y and $RP^2$ represents a repeating unit selected from the group consisting of

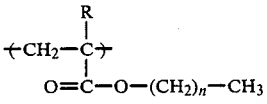
(i)

wherein n is an integer in the range from 1 to about 6

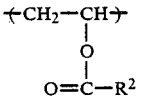
(ii)

and,

-continued

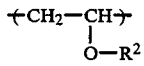

(iii)

$RP^3$ is any repeating unit containing an isocyanate-reactive OH group, preferably selected from the group consisting of

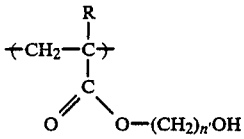

(i)

wherein n' is an integer-from 2 to 6

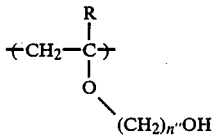

(ii)

wherein n'' is an integer from 0 to 6

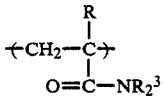

(iii)

wherein $R^3$ is H or $CH_2CH_2OH$, but only one may be H; x, y and z are numbers chosen so that the ratio z/(x+y) is in the range from about 0.05 to 0.5, preferably from 0.05 to 0.3; the ratio y/x ranges from 0 to about 1.0; x, y and z are present in relative heterogeneous order, that is, $RP^1$, $RP^2$, and $RP^3$ may be arranged in the polymer in a random order, or in blocks; provided that the number of OH groups per molecule is at least 3; and, m is an integer correlatable to the above mol wt range.

It is another specific object of this invention to provide a NPBA having at least 40 percent by weight (% by wt) acrylonitrile (AN) or acrylamide (AA), individually or in combination (that is, AN and/or AA constitute the major component) in an interpolymer having hydroxyl groups, the NPBA having a predetermined solubility parameter which may be controlled by varying x, y and z. Where the component monomers of the interpolymer are to be changed, the functional groups and the mol wt may each be varied, provided the number of OH groups per molecule is at least 3. The amount of NPBA to be added is sufficient to be adsorbed on the surfaces of the filler particles. The amount of filler particles, or loading of the composite may range from about 20 wt % to about 85 wt % based on the total weight of the composite.

DETAILED DESCRIPTION OF PREFERRED EMBODIMENTS

Figure 1:
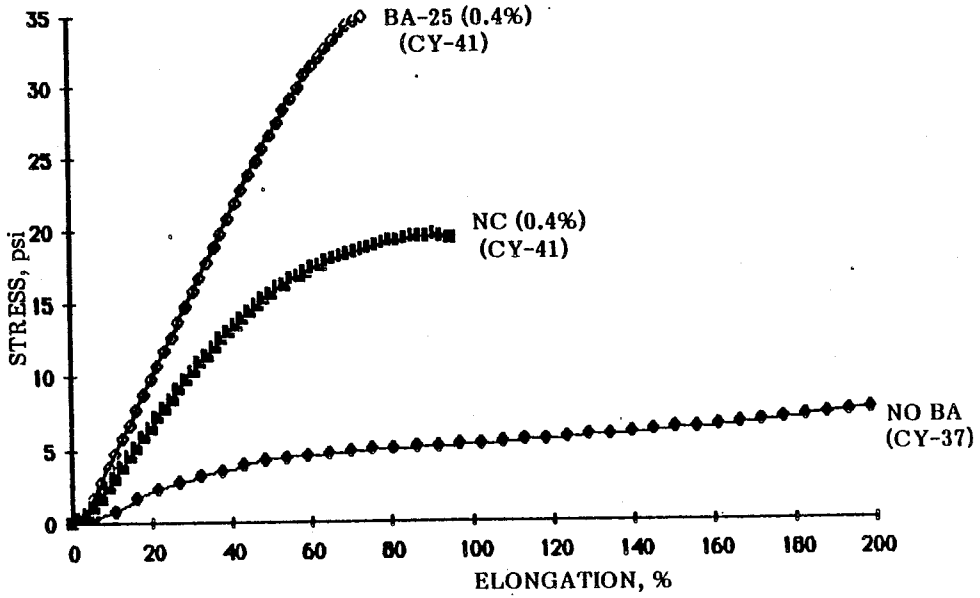
FIGS. 1, 2 and 3 are stress vs. strain graphs showing improved preformance obtained with bonding agents in three formulations.

In a particular embodiment of the invention, the composite is a propellant which consists essentially of the binder matrix and uncoated solid polar particles or filler free of a coupling agent such as an aminosilane. The filler consists essentially of oxidizing agent and fuel, typically aluminum particles. In a high energy composite propellant, the oxidizing agent is most preferably HMX or RDX, referred to herein as "nitramine crystals", in a size range from about 0.1 micron to about 500 microns, preferably in the range from about 1 micron to about 150 microns, constituting from about 40% to about 75% by weight of the composite (loading).

Nitramine crystals have at least one nitramine ($N-NO_2$) group, and preferably 2 to 5 such groups. Commercially available nitramines include RDX, HMX, nitroguanidine (NQ) and tetryl (2,4,6-trinitrophenylmethylnitramine).

The polymeric binder matrix used in solid propellants are derived from polyether-diols, triols and the like, and polybutadienediols, -triols and the like, with polyfunctional isocyanates as curing agents to produce polyurethanes. The binder matrix preferably consists essentially of (i) OH-terminated polyethers, such as polyethylene glycol (PEG), polypropylene glycol (PPG), poly(tetrahydrofuran) (PTHF), poly[bis(azidomethyloxetane)] homopolymer and interpolymers (polyBAMO), glycidyl azido polymer (GAP), and OH-terminated polyesters such as polyethyladipate, polycaprolactone, inter alia, (ii) a plasticizing agent preferably an energetic plasticizer, (iii) a polyfunctional isocyanate curing agent, and (iv) the non-NC neutral polymeric bonding agent (NPBA). Preferred energetic plasticizers are NG, METN, TMETN, TEGDN, BTTN, DEGDN, FEFO, BDNPF/A, defined hereinabove and referred to as nitro- and/or nitratoplasticizers.

The NPBA is used in propellant composites in an interfacial bond-improving (between the filler particles and binder matrix) amount, generally in a concentration in the range from about 0.05% to about 3% by wt of the binder, while the amount of binder ranges from about 15% to about 80% by wt, preferably less than 50% by wt of the total composite.

Though it is known that the relative affinity, K, of the bonding agent is critical, the criteria for obtaining a neutral and effective bonding agent for the nitramine crystals/polar binder systems was not understood, and if at all arrived at by trial and error, was accidental. In particular, no effective bonding agent has been known for nitroplasticized and/or nitratoplasticized, and specifically for NG-plasticized, propellants prior to this invention. The K is defined as the Adsorption on Solid Surface ($g/cm^2$) divided by Concentration in Submix ($g/cm^3$).

By "polar" I refer to a value derived from the solubility parameter "$\partial$" which value is at least 9 $(cal/cm^3)^{\frac{1}{2}}$, that is, a material having a SP equal to or greater than about 9 $(cal/cm^3)^{\frac{1}{2}}$ is referred to as being polar.

For optimum effect, K for the bonding agent ($K_{BA}$ should desirably be very large, that is, tend to infinity, $K_{submix}$ should be very small, that is, tend to zero, and $K_{BA}$ should be greater than $K_{polymer}$.

Either acidic or basic bonding agents tend to go to the surface more readily than a neutral one, and give the desired high K value, but the bonding agent must be essentially neutral, that is, in the range from about pH 5.5- pH 8.0, hence referred to as the NPBA. The unique characteristic of the NPBA is that it provides the high K, yet avoids degradation because it is a neutral macromolecule. The effect of the NPBA is noticeable even when used in very small amounts, in the range of from 0.05% to about 3% by wt of the binder, but is preferably used in the range from about 0.1% to about 1% by wt of the binder.

When the solid nitramine particles are dispersed in the submix consisting essentially of prepolymer, plasticizer and bonding agent, various molecules in the submix will be adsorbed on the solid surfaces competitively. To be effectively adsorbed, the K value of the bonding agent should be greater than that of the plasticizer or prepolymer, even when the polarity of the submix approaches that of the solid particles.

The polar plasticizers such as BTTN, DEGDN, NG, TEGDN, TMETN, BDNPF/A, or FEFO, and the prepolymer, typically PEG, PPG or polyBAMO, and GAP not only compete with the bonding agent for adsorption on the solid surfaces, but also may dissolve the bonding agent extensively. Hence, one has to utilize additional parameters which increase the K value of the bonding agent, but not that of the plasticizer or of the prepolymer.

Knowing that (A) the increase in free energy $(\Delta G)_s$, associated with the transfer of a particle to the surface from a solution of a given low mole fraction is about the same, regardless of the size of the particle involved, and (B) retention of the particle at the surface will tend to occur if the interaction energy $(W_a)$ is greater than $(\Delta G)_s$, one may conclude that macromolecules should undergo adsorption far more extensively than small molecules. The amount of energy required to transfer either a large or a small molecule to the surface, is about the same. However, a small molecule may provide but a single anchoring site for the energetic interaction at the surface, whereas a macromolecule provides a multiplicity of anchoring sites per molecule (train segments), thus increasing the interaction energy per molecule many-fold. Thus the extent of adsorption of a macromolecule is likely to be much greater than that of a small molecule, though their polarities are about the same. As a result, one might expect greater adsorption with a macromolecule than with a small molecule, even if the adsorption occurs from a very dilute solution. The large number of available adsorption sites per molecule of NPBA, and its adaptability because it is neutral, which allows it to be adjusted for preselected solubility in the submix by varying the mol wt and the monomer components, is an essential feature of the composite of this invention.

From the foregoing, the K of the bonding agent can be increased, without increasing that of the competing plasticizer, by using a macromolecule having a chain length long enough to provide plural contact points on the surface of a filler particle. Basic amino groups are not required to achieve this so that the bonding agent may be free of basic amino groups.

In addition, the NPBA macromolecule is preferably structured so that the submix and NPBA form a single phase above the slurry processing temperature. The "slurry" refers to filler dispersed in submix which is flowable. The slurry processing temperature is governed by the propellant composite to be produced, typically being in the range from about 32°-66° C. (90°-150° F.) for slurries using conventional submixes for an energetic system.

The NPBA is designed so that its critical temperature for phase separation, $T_c$, is at or slightly, preferably from about 3°-8° C. (5°-15° F.), above the slurry processing temperature for the particular binder matrix to be used, so that the NPBA will migrate towards the surfaces of the solid filler, and stay anchored during processing. The NPBA is too soluble when the $T_c$ is below the slurry processing temperature. Thus, the slurry processing temperature is always at, or below the $T_c$, preferably the latter.

The critical temperature for phase separation is estimated by a solubility study of NPBA in submix at different temperatures. In the molecular design of the NPBA I use the Flory-Huggins theory of polymer solutions combined with the concept of Hildebrand's solubility parameter. The free energy of mixing can be modified by varying the enthalpy and entropy of mixing. The enthalpy can be mainly modified by variation of repeating units in NPBA, and entropy mainly by variation of its mol wt.

Equations for the enthalpy and entropy of mixing are set forth in a paper entitled "Molecular Approach to Interfacial Bonding between Nitramine Crystals and Energetic (Plasticized) Binders" presented by me at the Office of Naval Research, Department of Navy, meeting on "Energetic Polymers and Their Characterization" at Great Oak Landing, Md. on October 31, 1986; and, the disclosure of this paper and of relevant portions of the references cited therein are incorporated by reference thereto as if fully set forth herein.

The critical condition for the solubility of NPBA in the submix is also affected by the molar volume of the solvent (submix) and the temperature, as dictated by the following equation:

$$(\delta_1-\delta_2)^2=0.5RT_c/v$$

wherein, $\delta_1$ the average solubility parameter of the solvent (submix), $\delta_2$ is the solubility parameter of the NPBA, $T_c$ is the critical temperature for phase separation, and, v is the molar volume of the solution.

With the approximation that the prepolymer(s) in the submix is the solvent, one can estimate the average molar volume of the mixed solvent (submix). Further, the critical temperature $T_c$ for the phase separation of the NPBA from solution, and the volume fraction at the critical point, $\phi_{2c}$, are hypothesized to be related to the mol wt according to the equations:

$$1/T_c=1/\theta[1+1/\psi_1(1/x^{\frac{1}{2}}+\tfrac{1}{2}x)]$$

$$\phi_{2c}=1/(1+x^{\frac{1}{2}})$$

where x is the ratio of molar volume of the polymer molecule to that of the solvent molecule, 104 1 is the excess entropy parameter, and $\theta$ is the THETA or Flory temperature.

When the mol wt approaches infinity, $T_c$ and $\phi_{2c}$ approach the THETA temperature and zero, respectively, the former becoming greater, and the latter becoming smaller, with increasing mol wt. Thus, NPBA with a very high mol is more preferred as long as it can be uniformly dispersed in the submix at slightly higher than the mix temperature. The higher the mol wt, the smaller the amount of NPBA remaining in the submix when phase separation occurs so that one chooses a NPBA with a $T_c$ value in the submix which (temperature) is close to the temperature at which the composite is processed. The NPBA can then be dispersed at a temperature higher than $T_c$, and after the solid particles are dispersed, the mixing temperature of the propellant can be lowered to $T_c$ or slightly below it.

Preferred macromolecules which meet the above criteria for a NPBA contain at least one of the functional groups selected from nitro, nitrato, cyano, sulfone, amide, sulfonamide or substituted amides such as cyanoethylated amides, and ammonium salts of sulfonic acid and carboxylic acids. Use of certain ammonium salts depresses the pH of the NPBA to about 5.5, and use of certain basic salts tend to raise the pH to about 8.5. Most preferred is a NPBA containing a cyano group derived from acrylonitrile. The cyano group is particularly preferred because (i) it has one of the highest group molar attraction constants; (ii) commercially available poly(acrylonitrile) has one of the highest solubility parameters, namely 15.4 $(cal/cm^3)^{\frac{1}{2}}$ which is much higher than the calculated values for NG and FEFO; and, acrylonitrile is a low cost, commercial monomer.

Examples of estimated and experimentally determined values of solubility parameter are shown for particular materials in Table 1 herebelow. The values were estimated using group molar attraction constants of Hoy (see *Polymer Handbook* 2d ed, Wiley Interscience IV-337, 1975) which were derived from measurement of vapor pressure. Where Hoy's value was unavailable, values derived from measurement of heat of evaporation by Small (*Polymer Handbook*, id.) were used.

TABLE 1

| Solubility Parameters | $(cal/cm^3)^{\frac{1}{2}}$ |
|---|---|
| A. Estimated | |
| Material | |
| HMX solid particles | 16.2 |
| RDX solid particles | 15.6 |
| NG energetic plasticizer | 11.7 |
| BTTN energetic plasticizer | 11.4 |
| TMETN energetic plasticizer | 11.0 |
| DEGDN energetic plasticizer | 10.7 |
| TEGDN energetic plasticizer | 10.5 |
| FEFO energetic plasticizer | 12.7 |
| BDNPF/A energetic plasticizer | 12.2 |
| B. Experimental | |
| PEG prepolymer | 12–13 |
| NC | 10–14 |
| PAN | 15.4 |
| PMA | 10–12 |
| PS | 8.6–9.1 |
| PAN is polyacrylonitrile | |
| PMA is polymethylacrylate | |
| PS is polystyrene, and, | |
| other acronyms are identified hereinbefore. | |

other acronyms are identified hereinbefore.

A predominantly acrylonitrile interpolymer was chosen based on its solubility parameter being between the values of those for nitramine crystals and the submix. The solubility parameter values were adjusted through incorporation of other monomers such as methyl acrylate, ethyl acrylate, or vinyl acetate and/or hydroxyethylacrylate.

The amount of plasticizer used depends in part upon the particular prepolymer used. The ratio of plasticizer to prepolymer will typically vary from about 0.25:1 to about 6:1, and preferably is at least 1:1. Illustrative examples for preparing a propellant composite with a high nitrato- and/or nitroplasticizer:prepolymer ratio (greater than 2), in which composite the plasticizer is highly polar, such as NG (SP 11.7), demonstrate the simple procedure.

A. Prepare the NPBA by a conventional polymerization of a predetermined molar ratio of monomers using a free radical initiator in the presence of a chain transfer agent, and recover the polymer with an appropriate workup.

B. Mix the NPBA with plasticizer and prepolymer, add solid fillers, then add the isocyanate and curative catalyst to prepare a castable mixture which, when cured, yields the desired composite. Casting temperature may be any temperature at which the mixture is castable but is preferably in the range from about 20° C. (68° F.) to about 60° C. (140° F.).

A typical energetic propellant composite is prepared as follows:

(a) uniformly disperse NPBA in a plasticizer at an elevated temperature in the range from about 120-150° F. preferably maintaining the temperature for several hours to obtain a single phase;

(b) add the prepolymer while mixing and maintaining the elevated temperature to form a homogeneous submix; when the prepolymer is a solid such as PEG, steps (a) and (b) may be combined;

(c) disperse the solid oxidizer particles, and any other modifiers such as metal fuel particles (aluminum), antifoaming agent, burning rate modifiers, wetting agent, stabilizer or ballistic modifier, while stirring to disperse the particles uniformly, and apply a vacuum while gradually lowering the temperature so as to approach the critical temperature for phase separation (typically in the range from about 38°–45° C. (90°–100° F.)) of the NPBA;

(d) mix in the polyfunctional isocyanate such as Desmodur L-2291A (commercially available from Mobay Chemical), while mixing under vacuum, preferably with a curative catalyst in an amount sufficient to form a polyurethane in the desired time of curing; and, (e) cast in a mold and cure at a curing temperature from about ambient temperature but below that which is deleterious to the composite, preferably in the range from about 32°–58° C. (80°–120° F.) until the composite is cured.

The result is a composite which has excellent tensile strength. Characteristically, the tensile strength of the composite with 50% filler loading, at 50% elongation of the composite, is at least double the tensile strength at 50% elongation of the same composite with the same loading but without a bonding agent.

A specific composite having a slurry processing temperature of 95° F. (42° C.) is prepared in a laboratory-scale preparation, as follows:

1. Add 0.1% nitrodiphenylamine (NDPA) into TMETN.
2. In a 100 ml plastic beaker, weigh in the NPBA and the plasticizer.
3. Gently swirl the mixture and keep it in the oven at 135° F. (57° C.) for about 4 hr but not longer than about 12 hr.
4. Add the prepolymer and swirl the mixture and keep it at 135° F. for about an hour. The submix should be stirred thoroughly at 135°–140° F. (57°–60° C.) to make sure that a good solution is obtained.
5. Add the solid filler particles with stirring.
6. Mix the slurry as it is cooled to 95° F. (42° C.) making sure the particles are dispersed uniformly, with no large aggregates of particles.

7. Place the beaker in a vacuum oven at 95° F., and degas. If a mechanical mixer is used, steps 6 & 7 may be combined. These steps, combined, may take from 0.5 to 1.5 hr.
8. Add the Desmodur L12291A at 95° F. and mix thoroughly for about 10 min, to disperse the curing agent uniformly.
9. Degas in the vacuum oven. Stir well once more, and add the catalyst, stirring to disperse it uniformly. If a mechanical mixer is used, steps 8 & 9 may be combined.
10. Degas in the vacuum oven and cast into a Petri dish. Cure in an oven at about 110° F. for 4 days.

EXAMPLE 1

In more detail, a particular NPBA is prepared having functional groups such as in the structure:

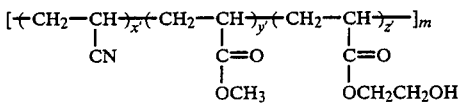

when x' is 1; y' is in the range from 0 to 0.5, preferably less than 0.5; and z' is in the range from about 0.1 to 0.5; and, m is an integer corresponding to a number average mol wt in the range from about 3000 to about 100,000.

In a specific example, 53.06 g (1.0 mole) acrylonitrile, 25.83 g (0.3 mole) methylacrylate, 23.22 g (0.2 mole) hydroxyethylacrylate, and 3.9 g (0.05 mole) of mercaptoethanol is polymerized with azoisobutyronitrile (AIBN, 3.0 g) in 100 ml acetone at 60° C. for 6 hr. The polymer is precipitated in methanol and washed with methanol. The recovered polymer has a OH equivalent weight of 350. The relative mol wt determined by gel permeation chromatography (GPC) using polystyrene as the standard, and dimethylformamide (DMF) as the solvent, shows a peak for 50,000.

The polymer is used as the NPBA (coded BA-25) in a slurry mix prepared as follows:

(a) Prepare the submix using a plasticizer/prepolymer ratio of 3. The prepolymer is a 7/3 mixture of (polyBAMO)/(nitratomethyl methyloxetane) (NMMO), in the amount 1.69 g (0.43 meq). The plasticizer is a 7/3 mixture of (TMETN)/(BDNPF/A), in the amount 5.78 g.

(b) Dissolve 0.4 wt % NPBA (0.056 g, 0.128 meq) directly in the plasticizer by stirring at 135° F., or by predissolving the NPBA in acetone and stripping off the acetone after dissolving the acetone solution in the submix.

(c) Add the solids, 6.3 g of 45 wt % HMX having an average particle size of 38 microns.

Add the curing agent, 0.177 g (0.89 meq) Desmodur L2291.

Add the curative catalyst, ferric acetyl acetonate (FeAA), 0.05 g of 5 wt % solution of FeAA in dimethylphthalate. (d) The slurry mix is cast in a Petri dish and stored for 4 days at 110° F. to prepare a cured composite sample coded (CY-41) for which test data are presented in FIG. 1. Results obtained with 0.4 wt % nitrocellulose (NC) as bonding agent in an analogously prepared composite coded CY-44, and another composite with no bonding agent (NO BA) coded CY-37, are also presented for comparison. Without bonding agent, it is evident the composite is very weak. At 50% elongation, it is seen that the stress with NC is almost triple the stress without any bonding agent, but the stress with the NPBA has been increased six-fold.

EXAMPLE 2

In a manner analogous to that described hereinabove, an NPBA (BA-20) is prepared by polymerizing 37.14 g (0.7 mole) acrylonitrile, 25.83 g (0.3 mole) methylacrylate, 11.61 g (0.1 mole) hydroxyethylacrylate, and 1.56 g of mercaptoethanol with AIBN (2.5 g) in 125 ml acetone at 60° C. for 6 hr. The GPC peak mol wt, determined as above, is 53,000 and the OH equivalent weight is 590.

The submix is prepared in a manner analogous to that described hereinabove, using a plasticizer/prepolymer ratio of 3, the energetic plasticizer being a mixture, 5.06 g, of equal parts by wt of TMETN and BDNPF/A. NPBA (0.1 meq), 0.06 g, was dissolved in the submix. The prepolymer is 1.45 g (0.66 meq) PEG-4500 (commercially available from Dow Chemical); the solids are 8.25 g 55 wt % HMX (38 micron avg size); the curing agent 0.182 g (0.99 meq) Desmodur L2291A; an the curative catalyst 0.05 g of 5 wt % solution of FeAA in dimethylphthalate.

The slurry mix containing 0.4 wt % NPBA is cured as before to yield a composite (PE-15) which is tested for strength and compared with analogously prepared composites containing 0.4 wt % NC, and no bonding agent.

Figure 2:
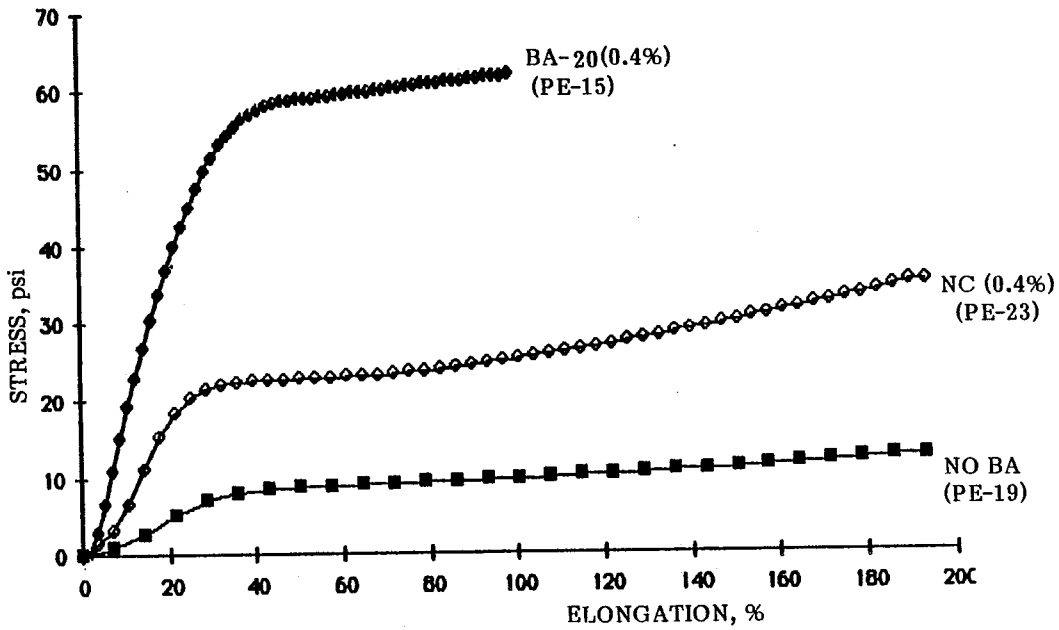

Test data obtained for a composite with BA-20 (0.4%), and another with NC (0.4%) are presented in FIG. 2. At 50% elongation, with no bonding agent the stress is about 10 psi; with the NC, stress is improved two-fold to about 20 psi; but with NPBA, stress is improved six-fold to about 60 psi.

EXAMPLE 3

In a manner analogous to that described hereinabove, an NPBA (BA-4) is prepared by polymerizing 53.06 g (1.0 mole) acrylonitrile and 23.22 g (0.2 mole) hydroxyethylacrylate, in the presence of 3.9 g of mercaptoethanol with AIBN (3.0 g) in 125 ml acetone at 60° C. for 6 hr. The GPC peak mol wt, determined as above, is 28,000 and the OH equivalent weight is 330.

The submix is prepared in a manner analogous to that described hereinabove, using a plasticizer/prepolymer ratio of 4, the plasticizer being a mixture, 20.0 g, of a 7/3 parts by wt of NG and BTTN. The prepolymer is 4.3 g (0.66 meq) PEG-8000 (commercially available from Dow Chemical); the solids are 50 g (50 wt %) HMX bimodal (ratio of avg particle sizes is 3/2=2/20 micron), 25 g (25 wt %) aluminum plus ammonium perchlorate having an avg particle size 30 to 70 microns; the curing agent 0.457 g (2.5 meq) Desmodur L2291A; and the curative catalyst 0.03 g triphenylbismuth.

The slurry mix of submix containing 0.1 wt % NPBA is cured as before to yield a composite which is compared for strength with a composite prepared in the same manner, except using an equivalent 0.1 wt % NC. Another composite is prepared using no bonding agent, and each is tested.

Figure 3:
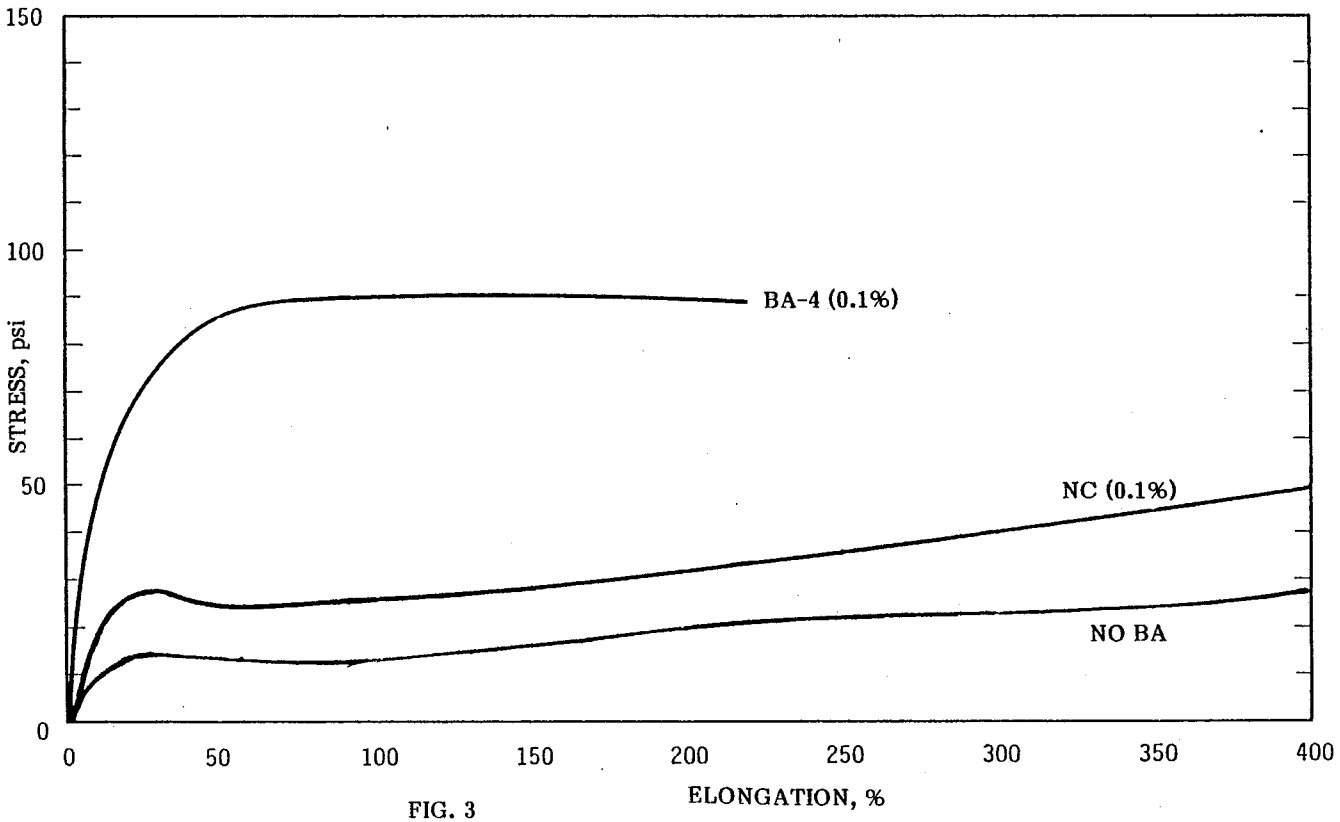

Test data obtained for the composite with BA-4 (0.1%) and NC (0.1%) are presented in FIG. 3. At 50% elongation, stress is about 25 psi with NC, but about 85 psi with BA-4.

In all of the above cases, test data for stress refer to nominal stress, namely, the force divided by the original cross-sectional area.

In each of the above cases, a composite without bonding agent has very little strength. It will be noted that the NPBA (BA-20) in Example 2 has the same monomer components as in BA-25 in 1, but the monomers are in different molar proportions; the NPBA (BA-4) of Example 3 has only two of the three monomers in BA-20 and BA-25.

Since the submix in each of the foregoing examples is different, the NPBA was tailored to keep the $T_c$ about the same (100° F.) for each NPBA in the submix solution. This was done by changing the values of x, y and z, and the mol wt.

I claim:

1. A filler-reinforced propellant composite comprising,
   (A) a binder matrix of polyurethane derived from a OH-terminated prepolymer and a polyfunctional isocyanate curing agent,
   (B) a polar plasticizer,
   (C) polar filler particles essentially insoluble in said binder matrix, said particles being in a size range large enough to benefit from interfacial bonding,
   (D) non-nitrocellulosic neutral polymeric bonding agent, NPBA, free of amine and acid groups, having a pH in the range from 5.5 to 8.5, a molecular weight in the range from about 3000 to about 500,000 and having at least three OH groups per molecule for reaction with said curing agent, yet having sufficient reactive OH groups remaining to undergo primary chemical bonding with the binder matrix through reaction with the curing agent, said NPBA being present in an amount sufficient to be adsorbed on at least a portion of the surfaces of enough particles to provide a predetermined composite strength, said curing agent being present in an amount sufficient to provide enough reactive groups to react with substantially all OH groups in said prepolymer and all OH groups in said NPBA, whereby tensile strength of said composite with 50% filler loading, at 50% elongation of said composite, is at least double the tensile strength at 50% elongation of the same composite with the same loading but without a bonding agent.

2. The composite of claim 1 wherein said polar plasticizer is an energetic nitro- or nitratoplasticizer, used in combination with said OH-terminated prepolymer, together forming a polar submix, said filler particles include an oxidizer, and optionally, fuel particles; said NPBA is soluble in said submix at above the slurry processing temperature and undergoes a phase separation at said slurry processing temeperature, said NPBA having at least 3 OH groups per molecule for reaction with said polyfunctional isocyanate curing agent, said prepolymer being cured with said polyfunctional isocyanate curing agent at a temperature below that deleterious to said composite.

3. The composite of claim 2 wherein said polar submix has a slurry processing temperature in the range from about 80° F. to about 150° F., and said NPBA has a critical temperature $T_c$ at or above the slurry processing temperature, said $T_c$ being in the range from above 80to about 160° F., so that the slurry processing temperature is always at or less than the $T_c$.

4. The composite of claim 3 wherein said NPBA is represented by the formula:

$$[(RP^1)_x-(RP^2)_y-(RP^3)_z]_m$$

wherein $RP^1$ represents a repeating unit selected from the group consisting of

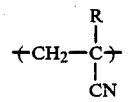
(i)

wherein R is H or methyl,

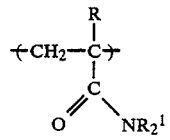
(ii)

wherein $R^1$ represents H or $CH_2CH_2CN$,

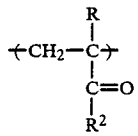
(iii)

wherein $R^2$ represents $C_1$–$C_4$ alkyl,

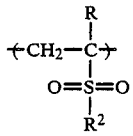
(iv)

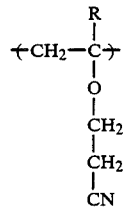
(v)

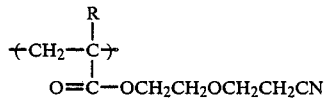
(vi)

and

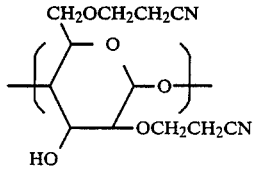
(vii)

$RP^2$ represents a repeating unit selected from the group consisting of

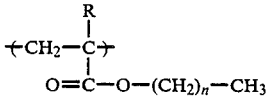
(i)

wherein n is an integer in the range from 1 to about 6

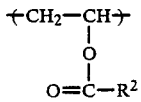

(ii)

and,

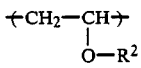

(iii)

$RP^3$ is any repeating unit containing an isocyanate-reactive OH group, being selected from the group consisting of

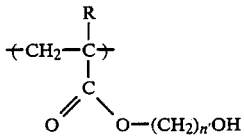

(i)

wherein n' is an integer from 2 to 6

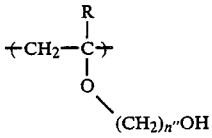

(ii)

wherein n'' is an integer from 0 to 6

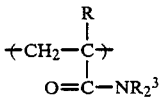

(iii)

wherein $R^3$ is H or $CH_2CH_2OH$, but only one may be H, x, y and z are numbers chosen so that the ratio z/(x+y) is in the range from about 0.05 to 0.5, preferably from 0.05 to 0.3; the ratio y/x ranges from 0 to about 1.0; x, y and z are present in relative heterogeneous order, that is, $RP^1$, $RP^2$, and $RP^3$ may be arranged in the polymer in a random order, or in blocks; provided that the number of OH groups per molecule is at least 3; and, m is an integer correlatable to said molecular weight range.

5. The composite of claim 4 wherein said oxidizer is a finely divided solid particle selected from the group consisting of a nitramine, ammonium perchlorate, and ammonium nitrate, and said nitramine is selected from the group consisting of cyclotetramethylenetetranitramine (HMX) and cyclotrimethylenetrinitramine (RDX).

6. The composite of claim 4 wherein said prepolymer is selected from the group consisting of (i) OH-terminated polyethers including polyethylene glycol (PEG), polypropylene glycol (PPG), poly(-tetrahydrofuran) (PTHF), poly[bis(azidomethyloxetane)]homopolymer and interpolymers (polyBAMO), glycidyl azido polymer (GAP), and., (ii) OH-terminated polyesters including polyethyladipate, and polycaprolactone.

7. The composite of claim 4 wherein said polar plasticizer is selected from the group consisting of a mixture of bis(dinitropropyl)formal and bis(dinitropropyl)acetal (BDNPF/A), bis(fluorodinitroethyl)formal (FEFO), nitratoesters including nitroglycerin (NG), trimethylol-trinitrate (TMETN), butanetrioltrinitrate (BTTN), diethyleneglycoldinitrate (DRGDN), and triethyleneglycoldinitrate (TEGDN).

8. The composite of claim 5 including a fuel particle selected from the group consisting of boron, aluminum, a metal hydride and an organic hydride.

9. The composite of claim 8 wherein said NFDA has the structure:

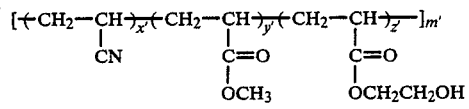

wherein x' is greater than y'+z'; when x' is 1, y, is in the range of from 0 to 0.5, and z' is in the range from about 0.1to less than 0.5; and, m' is an integer corresponding to a molecular weight in the range from about 5,000 to about 100,000.

10. A process for preparing a filler-reinforced propellant composite, comprising, (a) uniformly dispersing a non-nitrocellulosic neutral polymeric bonding agent free of amine and acid groups having a pH in the range from 5.5 to 8.5, and at least 3 OH groups per molecule, in a mixture of nitro- and/or nitratoplasticizer and OH-terminated prepolymer at an elevated temperature in the range from about 120°-50° F. to obtain a single phase;

(b) dispersing in said single phase, filler particles including solid oxidizer particles, optionally with metal fuel particles, metal hydrides, organic hydrides, and modifiers, to form a slurry;

(c) decreasing the temperature so as to approach the critical temperature of the neutral polymeric bonding agent for phase separation;

(d) mixing in a curing agent having OH-reactive functional groups in an amount sufficient to react with substantially all said reactive OH groups while maintaining the slurry in a fluent condition; and, (e) casting the fluent slurry in a molding cavity to cure at a curing temperature in the range from about 80°-120° F. until the composite is cured.

11. The process of claim 10 wherein said NPBA and nitro- and/or nitratoplasticizer are combined prior to adding said OH-terminated prepolymer at a temperature in the range from about 110°-140° F., said filler includes nitramine particles optionally with ammonium perchlorate, ammonium nitrate, aluminum and/or boron, said critical temperature is in the range from about 90°-110° F., and, said curing agent is a polyfunctional isocyanate.

12. The process of claim 11 wherein said NPBA is represented by the formula:

$$[(RP^1)_x-(RP^2)_y-(RP^3)_z]_m$$

wherein $RP^1$ represents a repeating unit selected from the group consisting of

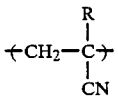

(i)

wherein R is H or methyl,

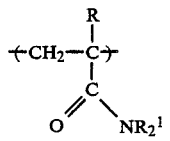

(ii)

wherein $R^1$ represents H or $CH_2CH_2CN$,

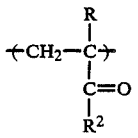

(iii)

wherein $R^2$ represents $C_1$–$C_4$ alkyl,

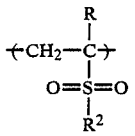

(iv)

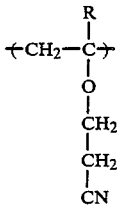

(v)

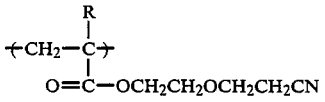

(vi)

and

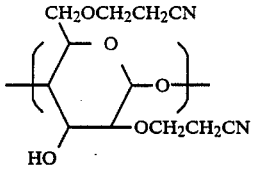

(vii)

$RP^2$ represents a repeating unit selected from the group consisting of

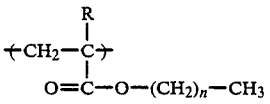

(i)

where n is an integer in the range from 1 to about 6

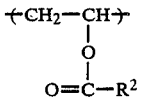

(ii)

and,

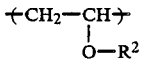

(iii)

$RP^3$ is any repeating unit containing an isocyanate-reactive OH group, being selected from the group consisting of

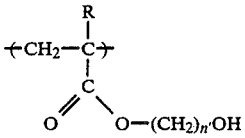

(i)

wherein n′ is an integer from 2 to 6

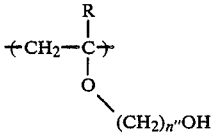

(ii)

wherein n″ is an integer from 0 to 6

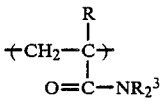

(iii)

wherein $R^3$ is H or $CH_2CH_2OH$, but only one may be H, x, y and z are numbers chosen so that the ratio $z/(x+y)$ is in the range from about 0.05 to 0.5, preferably from 0.05 to 0.3; the ratio $y/x$ ranges from 0 to about 1.0; x, y and z are present in relative heterogeneous order, that is, $RP^1$, $RP^2$, and $RP^3$ may be arranged in the polymer in a random order, or in blocks; provided that the number of OH groups per molecule is at least 3; and, m is an integer correlatable to a molecular weight in the range from about 3,000 to about 500,000.

13. The process of claim 12 wherein said NPBA is represented by the structure:

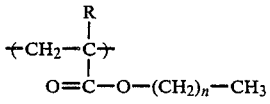

(i)

when x′ is 1, y′ is in the range from 0 to 0.5, and z′ is in the range from about 0.1 to less than 0.5; and, m′ is an integer corresponding to a molecular weight in the range from about 5,000 to about 100,000.

14. The process of claim 13 including adding a curative catalyst for said reaction of said polyfunctional isocyanate with said OH-terminated groups.

* * * * *